US007160041B2

(12) United States Patent
Klein

(10) Patent No.: US 7,160,041 B2
(45) Date of Patent: Jan. 9, 2007

(54) LINERLESS LABEL PRINTER WITH CONTROLLER TO RELIEVE PRINT PRESSURE FOLLOWING PRINT CYCLE

(75) Inventor: Rudolph J. Klein, Centerville, OH (US)

(73) Assignee: Paxar Americas, Inc., Miamisburg, OH (US)

( * ) Notice: Subject to any disclaimer, the term of this patent is extended or adjusted under 35 U.S.C. 154(b) by 142 days.

(21) Appl. No.: 10/935,365

(22) Filed: Sep. 7, 2004

(65) Prior Publication Data

US 2006/0051150 A1 Mar. 9, 2006

(51) Int. Cl.
*B41J 3/36* (2006.01)
*B41J 2/32* (2006.01)
*B41F 1/54* (2006.01)

(52) U.S. Cl. ..... 400/88; 400/120.01; 400/618; 400/611; 101/288; 156/384; 156/277

(58) Field of Classification Search ..... 400/88, 400/120.01, 120.16, 120.17, 649, 611, 614, 400/618; 101/288; 347/197, 198; 156/384, 156/277, 577, 579
See application file for complete search history.

(56) References Cited

U.S. PATENT DOCUMENTS 4,422,376 A * 12/1983 Teraoka ..... 101/69
4,477,305 A 10/1984 Hamisch, Jr. et al.
4,544,287 A * 10/1985 Teraoka ..... 400/120.16
5,040,461 A * 8/1991 Van-Ocker ..... 101/288
5,069,562 A * 12/1991 Matsuda ..... 400/630
5,487,337 A 1/1996 Uland
5,497,701 A 3/1996 Uland
5,806,993 A * 9/1998 Petterutti et al. ..... 400/88
5,868,893 A 2/1999 Kipper et al.
6,585,437 B1 7/2003 Wiklof et al.
6,607,318 B1 8/2003 Jorgensen et al.

FOREIGN PATENT DOCUMENTS

JP 2004-58553 2/2004
JP 2004-58554 2/2004

OTHER PUBLICATIONS

Linerless Addendum, © 1998 Monarch Marking Systems, Inc. TC9835LAD Rev. AB Jun. 1999.
Linerless Addendum, © 1998 Monarch Marking Systems, Inc. TC9835LAD Rev. AC Mar. 2000.

* cited by examiner

*Primary Examiner*—Leslie J. Evanisko
(74) *Attorney, Agent, or Firm*—Joseph J. Grass

(57) ABSTRACT

There is disclosed a hand-held printer for printing on linerless label webs wherein a thermal print head is maintained in pressure contact with the linerless web and a platen roll throughout successive printing cycles, but wherein the pressure is automatically relieved at or shortly after each printing cycle is completed.

1 Claim, 9 Drawing Sheets

LINERLESS LABEL PRINTER WITH CONTROLLER TO RELIEVE PRINT PRESSURE FOLLOWING PRINT CYCLE

BACKGROUND OF THE INVENTION

1. Field of the Invention

This invention relates to method and apparatus for printing on linerless labels.

2. Brief Description of the Prior Art

The following patent documents are made of record: U.S. Pat. No. 4,477,305; U.S. Pat. No. 5,487,337; U.S. Pat. No. 5,497,701; U.S. Pat. No. 5,868,893; U.S. Pat. No. 6,585,437; U.S. Pat. No. 6,607,318; Japanese 2004-58553, Feb. 26, 2004; Japanese 2004-58554, Feb. 26, 2004.

In prior art linerless label printers the linerless web, which can be composed of a web of label material with a release-coated printable side and a tacky adhesive on the other side, is fed between a print head and an adhesive-resistant:platen roll. The adhesive contacts the platen roll. The web passes between a print head and the platen roll. The print head exerts pressure on the paper and the platen roll. Because the platen roll is made adhesive-resistant by use of silicone rubber and/or by special coatings, the adhesive of the linerless web does not adhere aggressively to the platen roll unless the platen roll becomes worn or the print head is in pressure contact with the linerless web for an extended period of time. Should either or both of these conditions occur, the web can adhere excessively to the platen roll and when the web is advanced, the web can tend to follow around with the platen roll as the platen roll rotates during printing of the next label. Various ways have been tried to avoid this type of action, for example, picks or scrapers are used as in patents and U.S. Pat. No. 6,585,437, for example. Another way of dealing with this problem is disclosed in LINERLESS ADDENDUM, ©1998 Monarch Marking Systems, Inc. wherein the printer is manually opened to a position where the print head is spaced from the platen roll if the printer will be unused for extended periods of time.

SUMMARY OF THE INVENTION

It is a feature of the invention to provide improved method and apparatus for printing on linerless webs which involve relaxing the pressure between the print head and platen roll and on the intervening linerless label web following each printing cycle to prevent the linerless web from adhering excessively to the platen roll.

It is a feature of the invention to provide an improved linerless printing method and apparatus wherein the print head exerts pressure against the linerless web and against the platen roll during each printing cycle but wherein the pressure is automatically removed or reduced following printing to prevent excessive adherence of the adhesive on the linerless web to the platen roll.

BRIEF DESCRIPTION OF THE DIAGRAMMATIC DRAWINGS

DETAILED DESCRIPTION OF THE PREFERRED EMBODIMENTS

Figure 12:
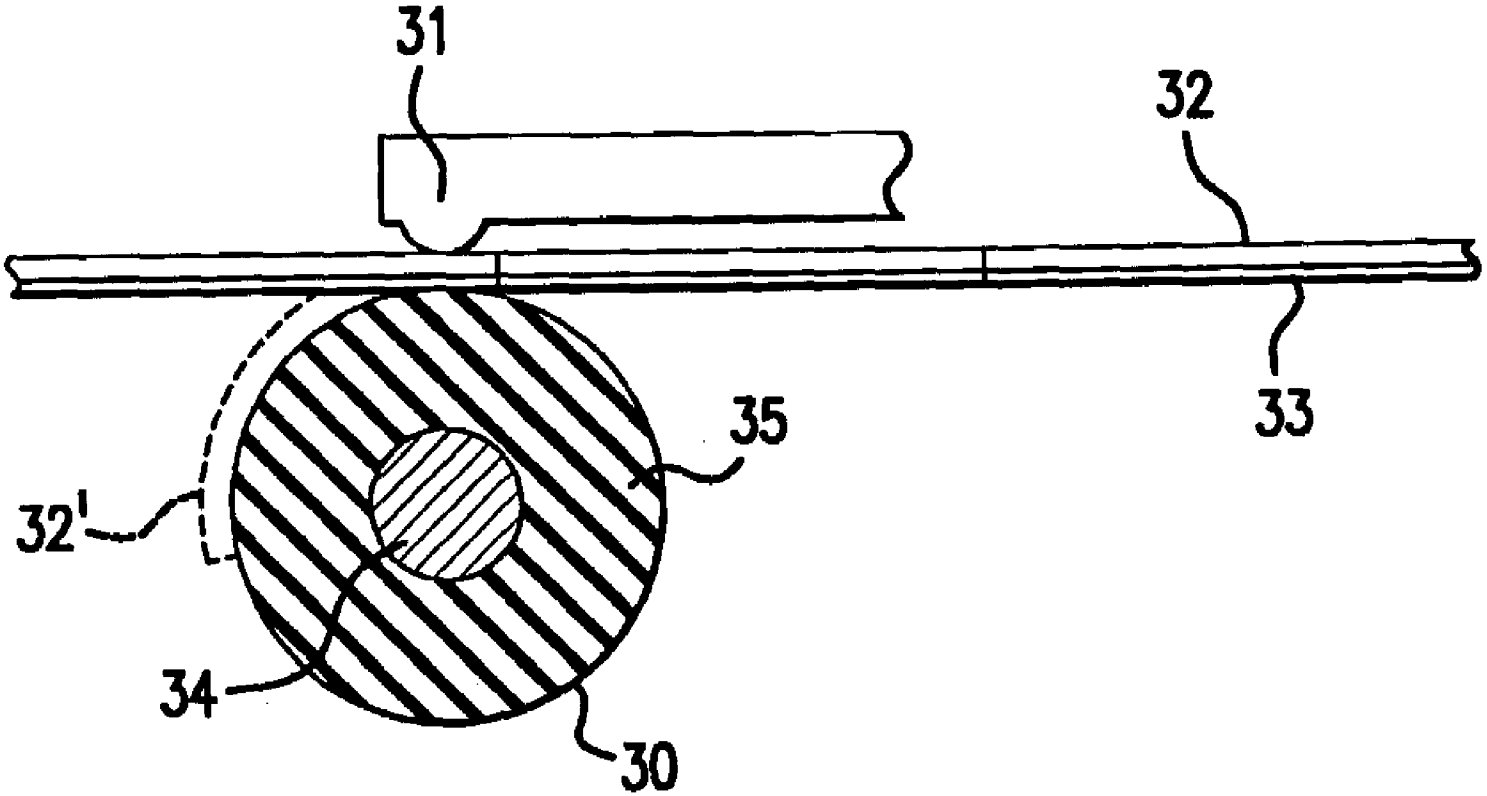
FIG. 12 PRIOR ART
FIG. 12 is a prior art depiction of a linerless label web between a print head and a platen roll.

With reference to FIG. 12, there is shown a prior art arrangement of a driven platen roll 30 cooperable with a print head 31 to print on a linerless web 32 of label material, wherein tacky adhesive 33, also known as pressure sensitive adhesive, is adhered to the underside of the web 32. The platen roll 30 includes a drive shaft 34 and a sleeve of resilient elastomeric material such as silicone rubber 35. The print head 31 prints on the printable surface of the web 32 opposite the adhesive 33 while the platen roll 30 advances the web 32. If the platen roll 30 is in contact with the adhesive 33 for a long period of time, the adhesive has the propensity to hold to the platen roll 30 tenaciously, and the web 32 may have a tendency to follow the platen roll around as indicated by broken lines 32'. To deal with this problem the present invention relieves the printing pressure following each printing cycle.

Figure 1:
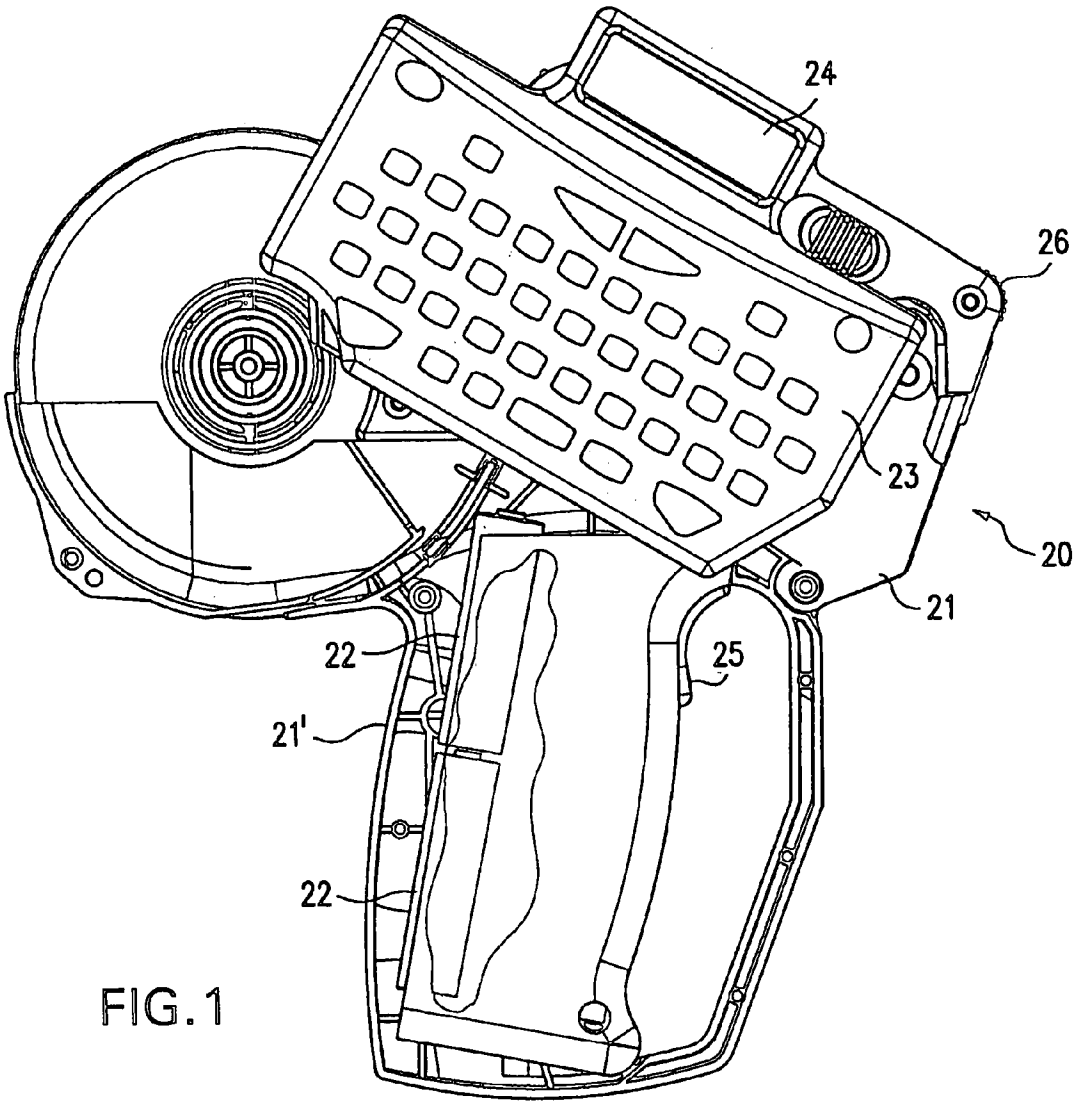
FIG. 1 is a right side elevational view of a hand-held label printer in accordance with the invention.

With reference to FIG. 1, there is shown a hand-held printer generally indicated at 20 having a housing or frame 21 with a handle 21' with parts broken away to show batteries 22 within the handle 21. A keyboard 23 is used to input data to the printer and a display 24 can display information entered by the keyboard, prompts and the like. A trigger switch 25 disposed at the handle 21 is used to initiate a printing cycle after data has been entered. An applicator 26 in the form of a roll is used to apply printed labels L to the article to be labeled.

Figure 2:
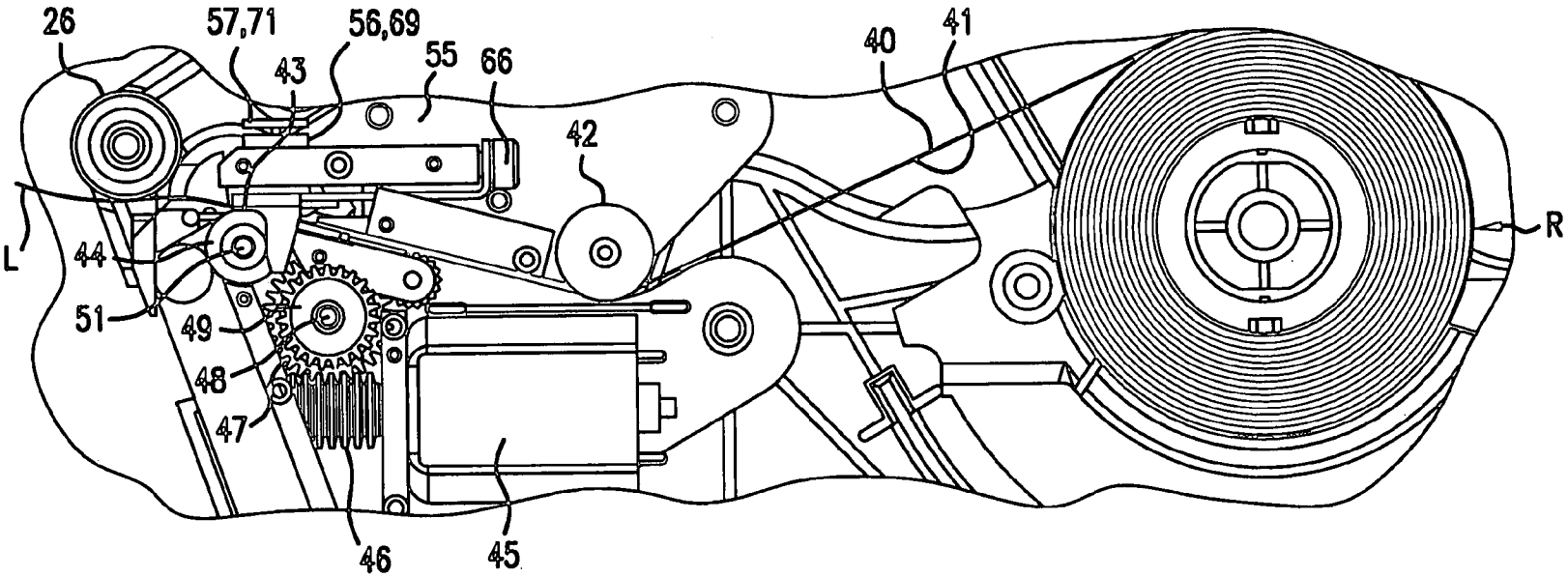
FIG. 2 is a fragmentary side elevational view showing the manner in which a label web from a supply roll passes through the printer.
Figure 3:
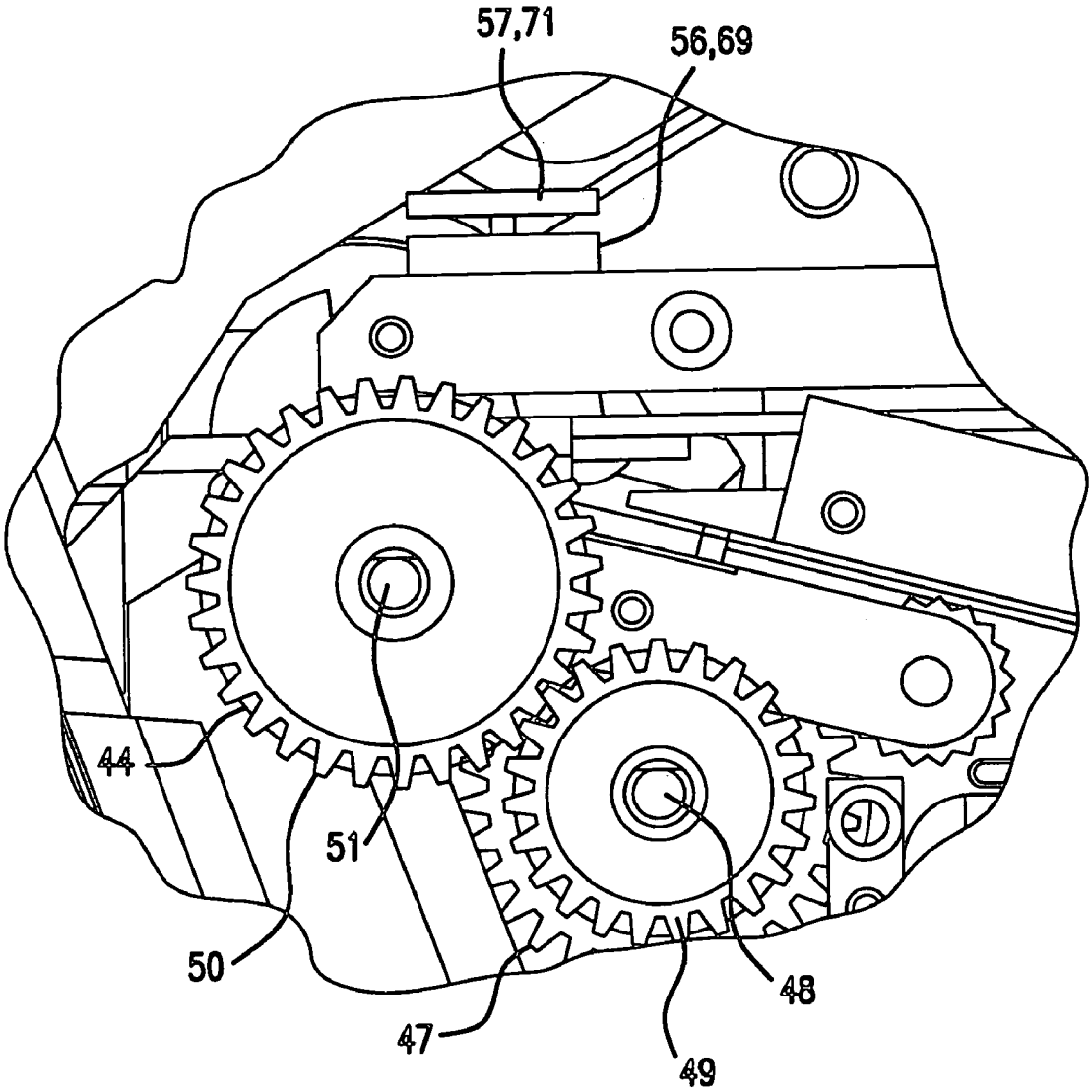
FIG. 3 is a fragmentary side elevational view showing gearing to drive the platen roll.

With reference to FIG. 2, there is shown a roll R of a linerless label web 40 having a coating of tacky or pressure sensitive adhesive 41 on its underside. The top side of the web 40 has a coating of a thermally responsive material (not shown). The web 40 passes from the roll R beneath a roll 42 and from there to a printing position between a thermal print head 43 and a platen roll 44. From there the web 40 passes into underlying relationship to the applicator 26. The platen roll 44 is driven by an electric motor 45 which is preferably a stepping motor. The motor 45 drives a worm gear 46 which meshes with a gear 47 keyed to a shaft 48. A gear 49 also keyed to the shaft 48 meshes with a gear 50 (FIGURE. 3) keyed to a shaft 51 for the platen roll 44.

Figure 5:
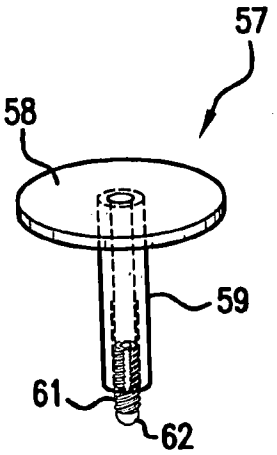
FIG. 5 is a perspective view of an armature assembly.
Figure 4:
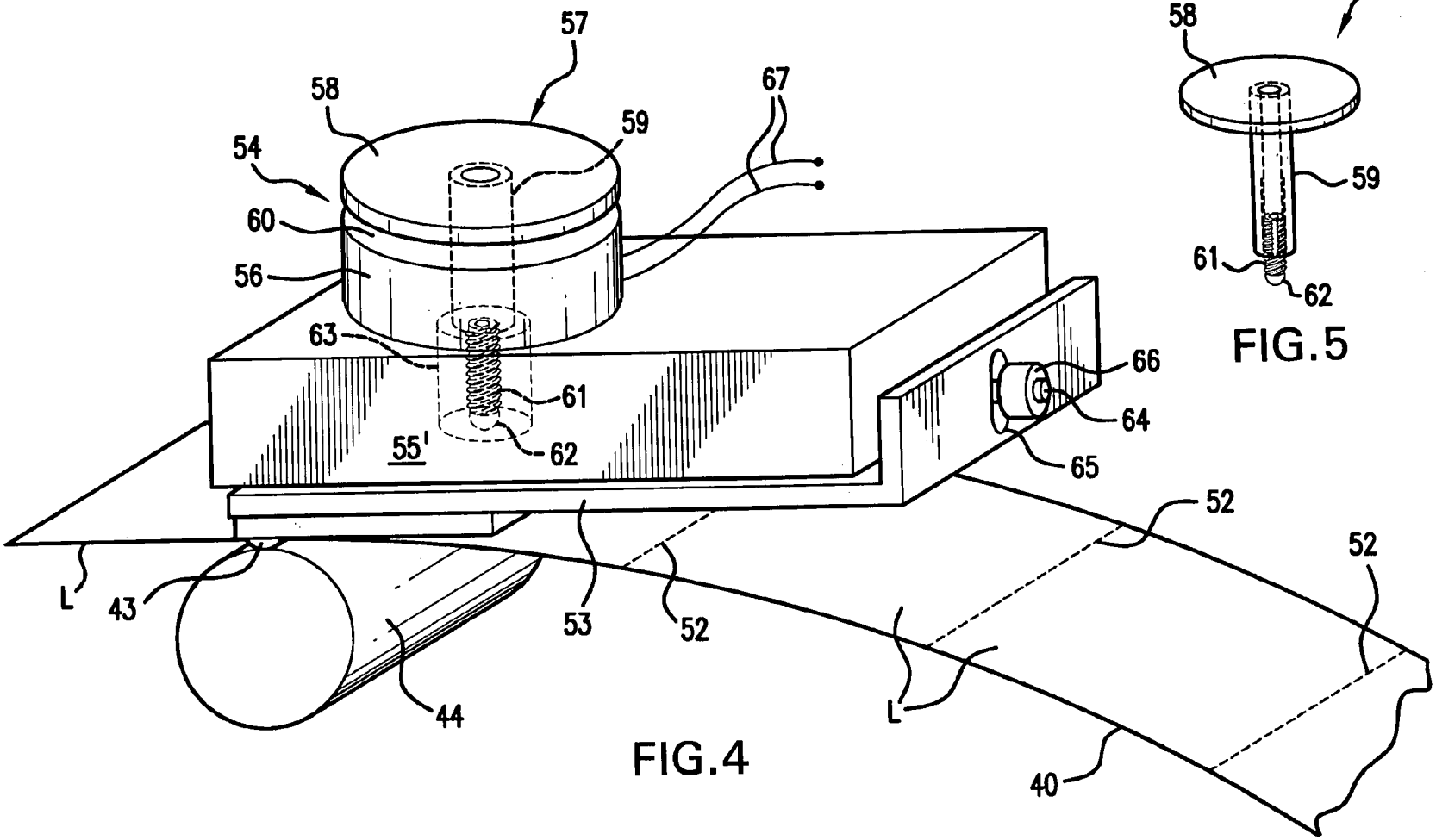
FIG. 4 is perspective diagrammatic view of a mechanism for moving the print head into printing cooperation with the platen roll.

As diagrammatically illustrated in FIG. 4, the web 40 has transversely extending lines of weakening 52 which divide the longitudinally extending web 40 onto labels L. The weakening can be provided by perforations which enable the leading label to be torn from the remainder of the web upon application of the leading label L by the applicator 26. The print head 43 is mounted on a print head carrying plate 53. An electromagnet or solenoid generally indicated at 54 is mounted to a block 55' secured to frame member 55 (FIG. 2) of the printer 20 and a coil 56 of the electromagnet 54 is mounted to the block 55'. An armature 57 includes a flat electromagnetically-responsive disc 58 and a cylindrical shaft 59. The disc 58 is close to but is spaced from a surface 60 of the coil 56. The shaft 59 includes an adjusting screw 61 having a rounded end 62. The rounded end 62 rests against the plate 53. The block 55' is cored out as indicated at 63 to permit free movement of the shaft 59 and its adjusting screw 61. The block 55' threadably receives a threaded stud 64 which passes through an elongate enlarged slot 65. A nut 66 is threaded onto the stud 64. This arrangement enables the print head carrying plate 53 to pivot relative to the block 55'. Energization of the coil 56 via conductors 67 will cause the disc 58 to be drawn toward the coil 56 which in turn will cause the rounded end 62 to bear with greater force against the plate 53 to pivot the plate 53 so that the print head 43 bears with printing pressure against the platen roll 44. This printing pressure exists until the coil is de-energized, at which time the force exerted by the print head is reduced or eliminated. FIG. 5 shows the armature 57 in greater detail.

Figure 7:
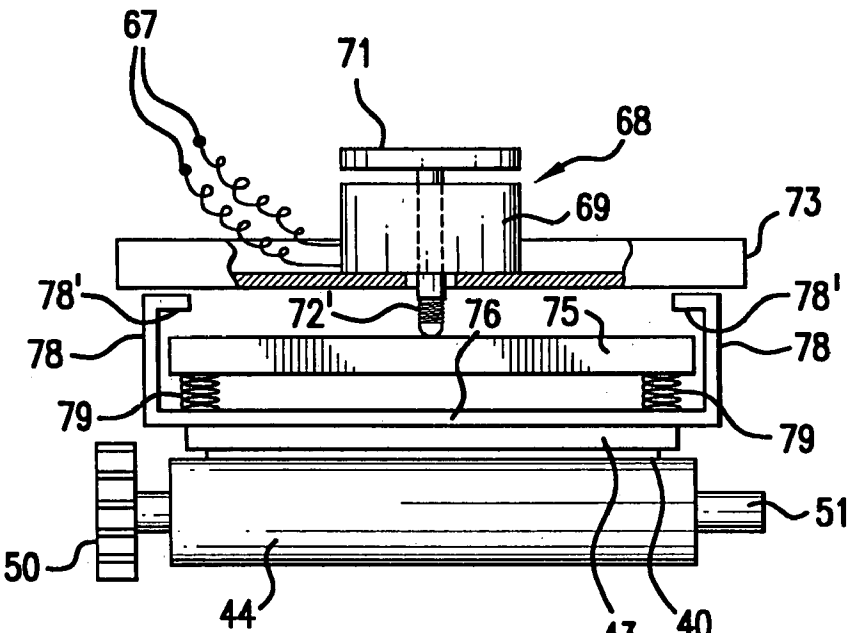
FIG. 7 is a view similar to FIG. 7, but showing the print head under printing pressure.
Figure 6:
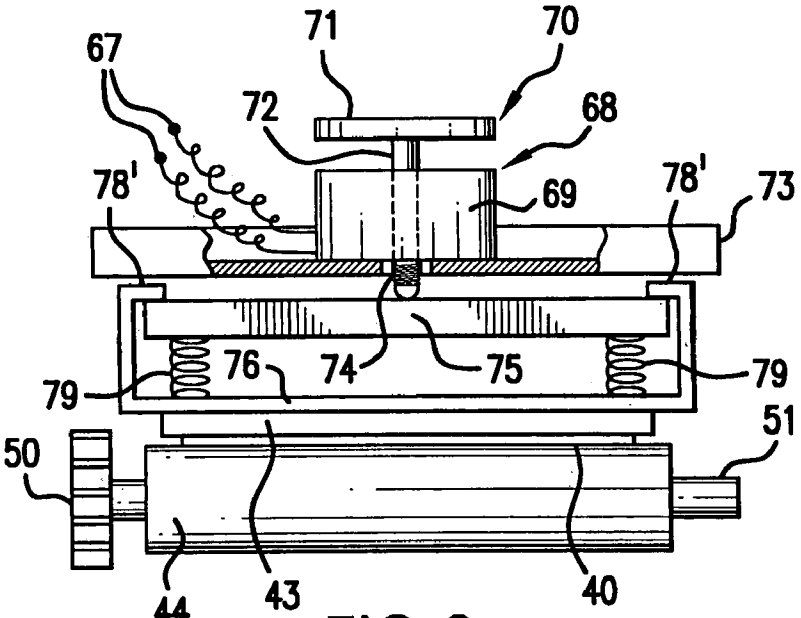
FIG. 6 is a partly sectional view showing one embodiment of a control assembly for the print head, wherein printing pressure is relaxed.

FIGS. 6 and 7 illustrate another embodiment wherein an electromagnet 68 includes a coil 69 and an armature 70 having an electromagnetically-responsive disc 71 and a shaft 72. The coil 69 is secured to a support 73 secured to the frame 55. The shaft 72 extends through a hole 74 in the support 73. The shaft 72 has a screw threaded portion 72' which threads adjustably into the remainder of the shaft 72 and its rounded terminal end bears against a plate 75. The plate 75 is spaced from a plate 76 which mounts the print head 43. The plate 76 includes brackets 78 with flanges 78' that overlie the plate 75 to limit the travel of the plate 76 and the print head 44. A pair of compression springs 79 bias the plates 75 and 76 relatively away from each other. In FIG. 6 the plate 75 is shown in abutment with the flanges 78'. FIG. 6 shows the coil 69 as being de-energized so the springs 79 are only under slight compression. FIG. 7 shows the coil 69 as being energized, thereby compressing the springs 79 so that the print head exerts printing pressure against the web 40 and the platen roll 44.

Figure 8:
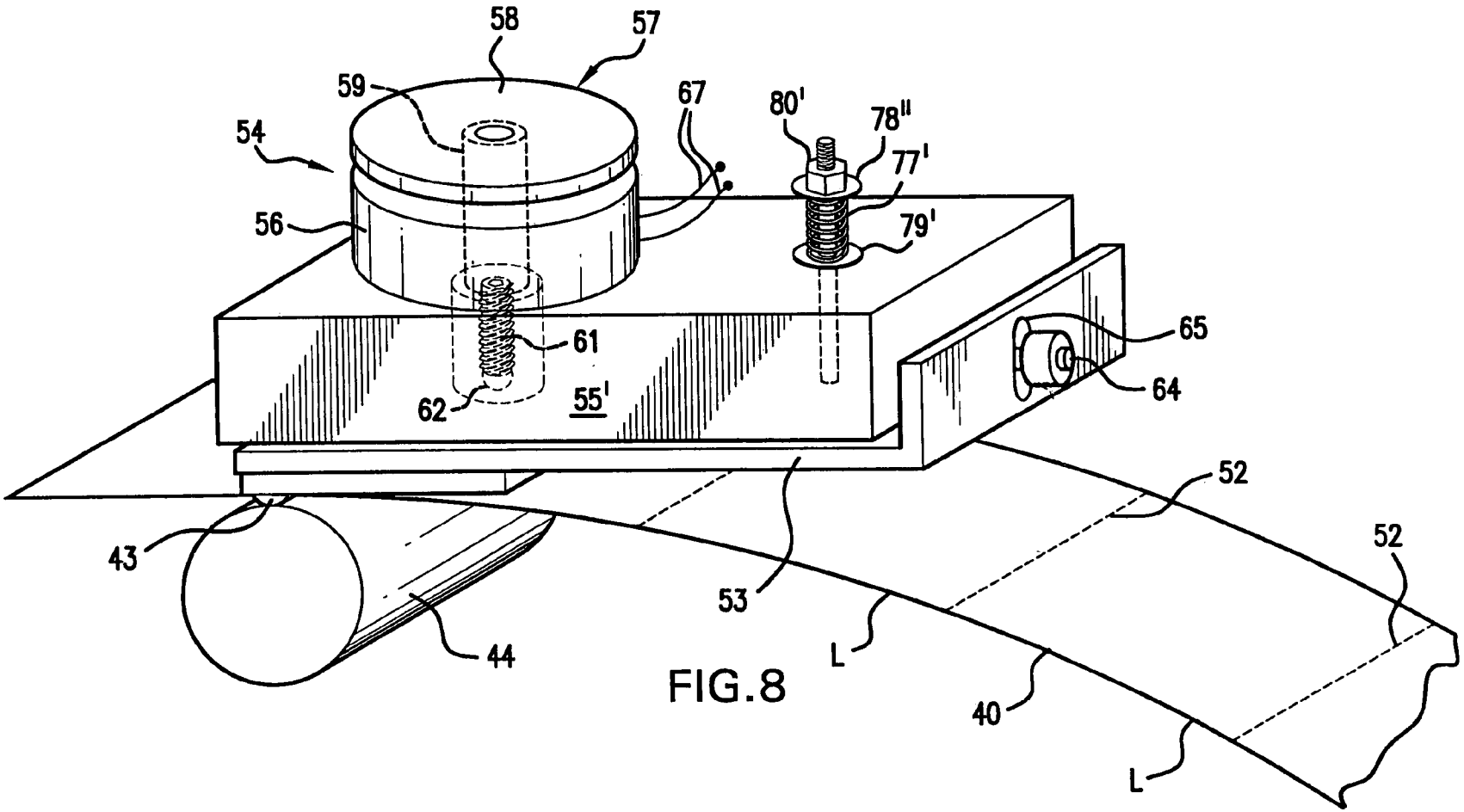
FIG. 8 is a view similar to the embodiment of FIGS. 4 and 5 but showing an alternative form of print head control mechanism.
Figure 9:
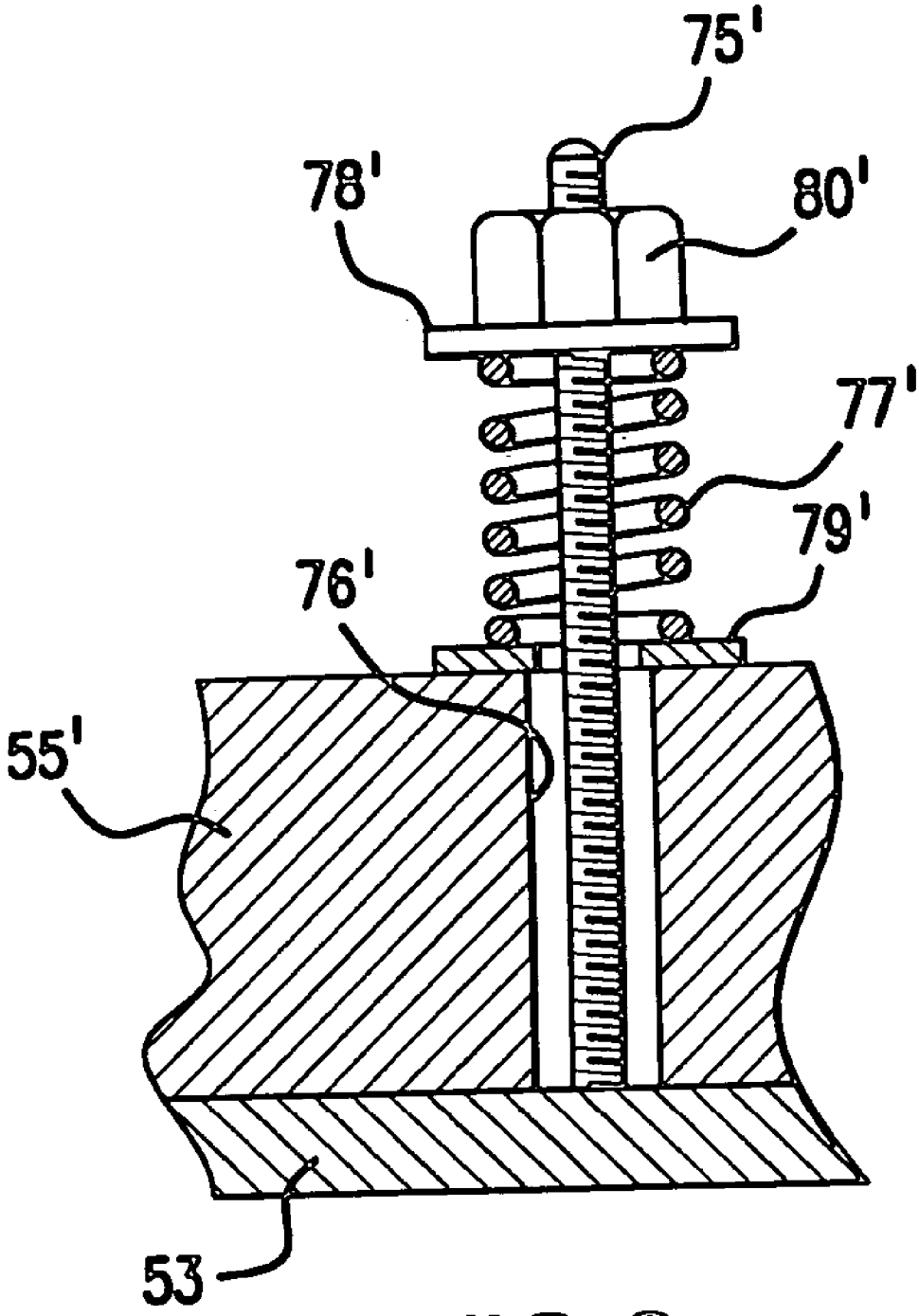
FIG. 9 is a sectional view of a fragmentary portion of the print head control mechanism.

The embodiment of FIGS. 8 and 9 is the same as the embodiment of FIGS. 1 through 5, except that the print head 43 is held spaced from the platen roll 44 except when the coil 56 is energized. A threaded stud 75' secured to the plate 53 passes through an enlarged hole 76'. A compression spring 77' is positioned between washers 78" and 79' under compression. A nut 80' threaded into the stud 75' enables the force of the spring 77' to be adjusted. When the coil 56 is energized the plate 53 can pivot slightly to bring the print head 43 into printing pressure contact with the web 40 and the platen roll 43.

Figure 10:
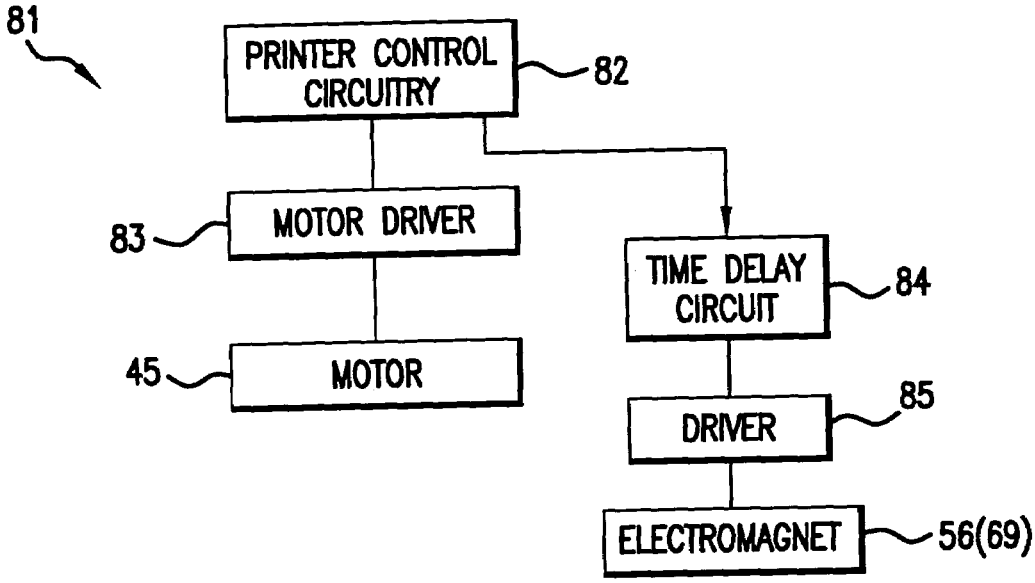
FIG. 10 is a block diagram.

With reference to FIG. 10, there is shown a block diagram of the control system generally indicated at 81. Block 82 represents a controller or printer control circuitry which includes a microprocessor for controlling the printer 20. The circuitry 82 controls a motor driver 83 to drive the motor 45 to in turn drive the platen roll 44 during each printing cycle. The circuitry 82 also controls the energization of the coil 56 (or 69). The energization of the coil 56 or 69 continues during the printing cycle and preferably also thereafter for a predetermined period of time to allow the user enough time to apply the label using the applicator 26. The print head 43 acts as a brake while the leading label L is being applied to prevent loss of print registration and excessive unwinding of the roll R. As shown, a time delay circuit 84 is controlled by the circuitry 82. A driver 85 energizes the coil 56 or 69 from the start of the printing cycle until a predetermined period of time has passes after the end of the printing cycle. Alternatively, a mechanical brake (not shown) can be used and the coil 56 or 69 can be de-energized as soon as the printing cycle is complete.

Figure 11:
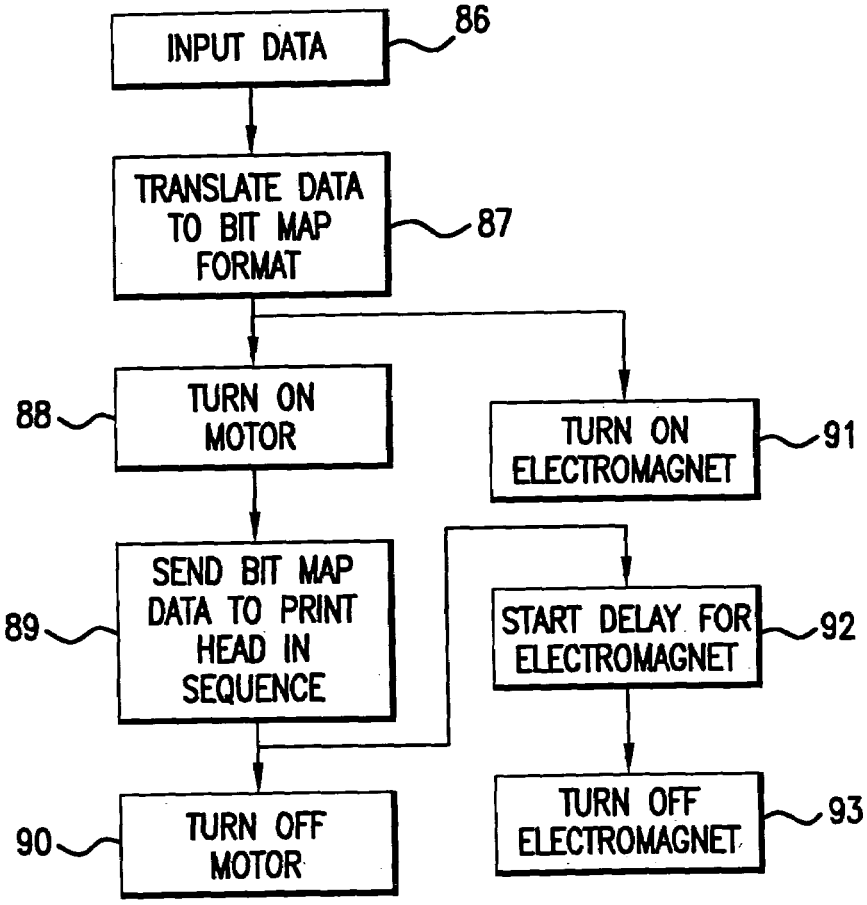
FIG. 11 is a flow chart depicting the control sequence.

With reference to FIG. 11, data is first inputted from the keyboard 23 or a suitable external source as indicated at 86. Next the data is translated into a bit map format as indicated at 87. When the trigger switch 25 is operated, the motor 45 is turned on as indicated at 88. At the same time the coil 56 or 69 is energized as indicated at 91. After the motor 45 brings the platen roll up to its printing speed, the bit map data is sent to the print head as indicated at 89. When the printing cycle is complete, the motor 45 is turned off as indicated at 90. Even though the motor 45 has been turned off the coil 56 or 69 remains energized as indicated at 92 for a finite period of time, for example five seconds, so that the user has time to apply the leading label L at which time current flow to the coil 56 or 69 is terminated as indicated at 93. While the coil 56 or 69 remains energized, the web 40 is clamped between the print head 43 and platen roll 44 and as the user applies the label L with the applicator 26, the leading label is torn from the remainder of the web 40 along a line of weakening 52 without causing the web to move out of registration with the print head 43.

The invention is not limited to a portable or hand-held printer but is applicable to a stationary printer that prints or prints and applies linerless labels.

Other embodiments and modifications of the invention will suggest themselves to those skilled in the art, and all such of these as come within the spirit of this invention are included within its scope as best defined by the appended claims.

The invention claimed is:

1. A hand-held printer, comprising:

a hand-held housing having a handle, the handle having space to house a battery, a thermal print head on the housing, an adhesive-resistant platen roll on the housing and cooperable with the print head to print on a web of linerless labels having tacky adhesive, wherein the tacky adhesive is cooperable with the platen roll, an electromagnet disposed on the housing and coupled to the print head to move the print head into cooperation with the web and the platen roll, a spring to urge the print head out of cooperation with the platen roll and the linerless web to prevent excessive adherence of the adhesive to the platen roll, an applicator on the housing to apply printed labels, an electric motor to move the platen roll to advance the web, wherein the print head, the electric motor and the electromagnet are powered by the battery, and a controller (a) to energize the electromagnet during printing and for a predetermined period of time thereafter to enable the label to be applied by the applicator, (b) to de-energize the electromagnet at the end of the period of time, (c) to control the print head during printing, (d) and to advance the web during printing, and wherein the print head acts as a brake against the web while the label is being applied.

* * * * *